US008351612B2

(12) United States Patent
Yoo et al.

(10) Patent No.: US 8,351,612 B2
(45) Date of Patent: Jan. 8, 2013

(54) APPARATUS FOR GENERATING AND PLAYING OBJECT BASED AUDIO CONTENTS

(75) Inventors: Jae-Hyoun Yoo, Daejeon (KR); Hwan Shim, Seoul (KR); Hyun-Joo Chung, Seoul (KR); Koen-Mo Sung, Seoul (KR); Jeongil Seo, Daejeon (KR); Kyeongok Kang, Daejeon (KR); Jin-Woo Hong, Daejeon (KR); Chieteuk Ahn, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 367 days.

(21) Appl. No.: 12/628,317

(22) Filed: Dec. 1, 2009

(65) Prior Publication Data

US 2010/0135510 A1 Jun. 3, 2010

(30) Foreign Application Priority Data

Dec. 2, 2008 (KR) ..... 10-2008-0121112
Mar. 10, 2009 (KR) ..... 10-2009-0020190

(51) Int. Cl.
*H04R 5/00* (2006.01)
*H04R 5/02* (2006.01)
*G10L 19/00* (2006.01)

(52) U.S. Cl. ..... 381/23; 381/22; 381/307; 704/500; 704/501

(58) Field of Classification Search ..... 700/94; 704/500, 501; 381/21–23, 119, 307, 300
See application file for complete search history.

(56) References Cited

U.S. PATENT DOCUMENTS

2004/0111171 A1* 6/2004 Jang et al. ..... 700/94
2005/0141723 A1* 6/2005 Lee et al. ..... 381/26
2006/0115100 A1 6/2006 Faller

FOREIGN PATENT DOCUMENTS

EP 1 416 769 A1 5/2004
KR 1020070066820 A 6/2007

* cited by examiner

*Primary Examiner* — Xu Mei
*Assistant Examiner* — Douglas Suthers
(74) *Attorney, Agent, or Firm* — Ladas & Parry LLP

(57) ABSTRACT

Disclosed is an object based audio contents generating/playing apparatus. The object based audio contents generating/playing apparatus may include an object audio signal obtaining unit to obtain a plurality of object audio signals by recording a plurality of sound source signals, a recording space information obtaining unit to obtain recording space information with respect to a recording space of the plurality of sound source signals, a sound source location information obtaining unit to obtain sound location information of the plurality of sound source signals, and an encoding unit to generate object based audio contents by encoding at least one of the plurality of object audio signals, the recording space information, and the sound source location information, thereby enabling the object based audio contents to be played using at least one of a WFS scheme and a multi-channel surround scheme regardless of a reproducing environment of the audience.

9 Claims, 5 Drawing Sheets

APPARATUS FOR GENERATING AND PLAYING OBJECT BASED AUDIO CONTENTS

CROSS-REFERENCE TO RELATED APPLICATION

This application claims the benefit of Korean Patent Application No. 10-2008-0121112, filed on Dec. 2, 2008, and Korean Patent Application No. 10-2009-0020190, filed on Mar. 10, 2009, in the Korean Intellectual Property Office, the disclosures of which are incorporated herein by reference.

BACKGROUND

1. Field

Example embodiments relate to an object based audio contents generating/playing apparatus, and more particularly, to an object based audio contents generating/playing apparatus that may generate/play object based audio contents regardless of a user environment of the object based audio contents.

2. Description of the Related Art

MPEG-4 is an audio/video encoding standard proposed by a moving picture expert group (MPEG), the affiliated organization of an international organization for standardization/international electrotechnical commission (ISO/IEC), in 1998. MPEG-4 is developed from a standard system of MPEG-1 and MPEG-2 and additionally includes a virtual reality markup language (VRML) and contents relating to an object-oriented composite file, and the like. MPEG-4 aims at increasing an encoding rate, developing an integrated method of encoding an audio, a video, and a voice, enabling interactive audio/video to be played, and developing an error restoring technique.

MPEG-4 has a main feature of playing an object based audio/video. That is, MPEG-1 and MPEG-2 is limited to a general structure, a multi-transmission, and synchronization, whereas MPEG-4 additionally includes a scene description, interactivity, contents description, and a possibility of programming. MPEG-4 classifies a target for encoding for each object, sets an encoding method according to an attribution of each object, describes a desired scene, and transmits the described scene in an audio binary format for scenes (Audio-BIFS). Also, audiences may control information such as size of each object, a location of each object, and the like, through a terminal, when listening to the audio.

As a representative object based audio contents playing method, there is wave field synthesis (WFS) scheme. The WFS scheme generates a wavefront identical to a first wavefront in a space classified as a loudspeaker array by synthesizing sounds played through a plurality of loudspeakers from the first wavefront generated from a first sound source.

A standardization project relating to the WFS scheme, namely, a creating assessing and rendering in real time of high quality audio-visual environments in MPEG-4 context (CARROUSO), has conducted research to transmit a sound source in a form of an object through MPEG-4 having a feature of object-oriented and commutativity, and to play using the WFS scheme.

SUMMARY

Example embodiments may provide an object based audio contents generating/playing apparatus that enables the object based audio contents to be played using at least one of a wave field synthesis (WFS) scheme and a multi-channel surround scheme regardless of a reproducing environment of the audience.

According to example embodiments, there may be provided an apparatus of generating an object based audio contents, the apparatus including an object audio signal obtaining unit to obtain a plurality of object audio signals by recording a plurality of sound source signals, a recording space information obtaining unit to obtain recording space information with respect to a recording space of the plurality of sound source signals, a sound source location information obtaining unit to obtain sound location information of the plurality of sound source signals, and an encoding unit to generate object based audio contents by encoding at least one of the plurality of object audio signals, the recording space information, and the sound source location information.

According to example embodiments, there may be provided an apparatus of reproducing object based audio contents, the apparatus including a decoding unit to decode a plurality of object audio signals of a plurality of sound source signals and sound source location information of the plurality of sound source signals, from the object based audio contents, a reproducing space (area) information obtaining unit to obtain reproducing space information with respect to a reproducing space of the plurality of object based audio contents, a signal synthesizing unit to synthesize a plurality of speaker signals from the decoded plurality of object audio signals based on the sound source location information and the reproducing space information, and a transmitting unit to transmit the plurality of speaker signals to a plurality of speakers respectively corresponding to the plurality of speaker signals.

Additional aspects and/or advantages will be set forth in part in the description which follows and, in part, will be apparent from the description, or may be learned by practice of the embodiments.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
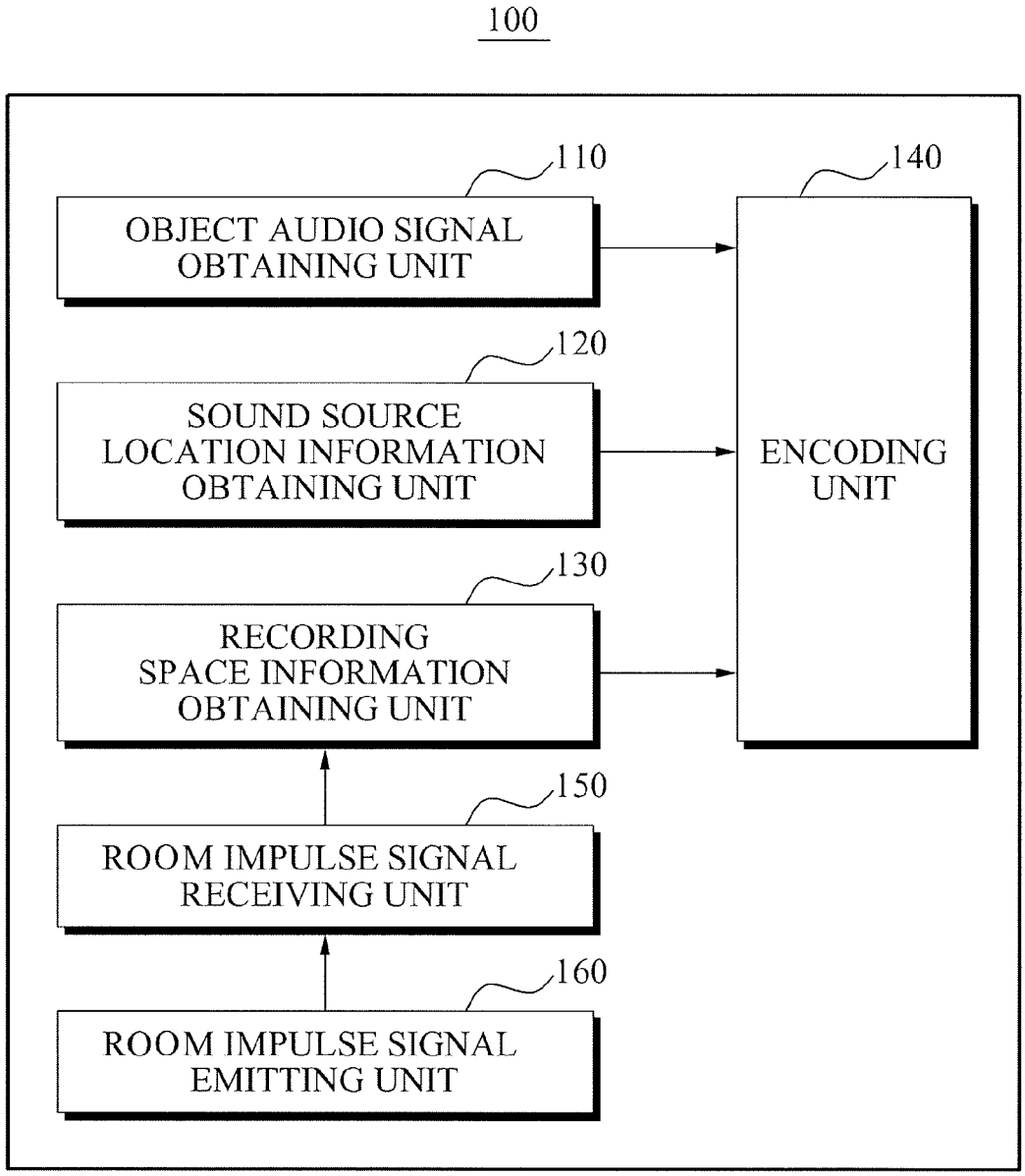
FIG. 1 is a block diagram illustrating a detailed configuration of an object based audio contents generating apparatus according to example embodiments.

Reference will now be made in detail to example embodiments, examples of which are illustrated in the accompanying drawings, wherein like reference numerals refer to the like elements throughout. Example embodiments are described below to explain the present disclosure by referring to the figures.

FIG. 1 is a block diagram illustrating a detailed configuration of an object based audio contents generating apparatus according to example embodiments.

According to example embodiments, the object based audio contents generating apparatus 100 may include an object audio signal obtaining unit 110, a sound source location information obtaining unit 120, a recording space information obtaining unit 130, and an encoding unit 140. Also, according to example embodiments, the object based audio contents generating apparatus 100 may further include a room impulse signal emitting unit 160 and a room impulse signal receiving unit 150. Hereinafter, a function of each element will be described in detail.

The object audio signal obtaining unit 110 obtains a plurality of object audio signals by recording a plurality of sound source signals.

In this instance, a number of the plurality of sound source signals is identical to a number of object audio signals. That is, the object audio signal obtaining unit 110 may obtain a single object audio signal for a single sound source signal.

According to example embodiments, the object audio signal obtaining unit 110 may obtain the plurality of object audio signals using at least one of a plurality of spot microphones and a microphone array.

Each of the plurality of spot microphones is installed adjacent to each of plurality of sound sources, thereby obtaining an object audio signal by recording a sound source signal from each of the plurality of sound sources.

The microphone array is an arrangement of the plurality of microphones. When the microphone array is used, a plurality of object audio signals may be obtained for each sound source by classifying the plurality of sound source signals using a delay time and a sound pressure level (SPL) of a plurality of sound source signals that arrive at the microphone array.

Here, the delay time of the plurality of sound source signals may include at least one of a delay time between a plurality of sound sources that arrive at a single microphone from among the plurality of microphones constituting the microphone array, and a delay time of a sound source signal that arrives at each of the plurality of microphones, when a single sound source signal arrives at each of the plurality of microphones.

The sound source location information obtaining unit 120 obtains sound source location information of the plurality of sound source signals.

Here, the sound source location information includes information with respect to a space where a plurality of sound signals to be recorded are to be played. That is, the sound source location information may include sound image location information. The sound location information, namely, sound image location information, may be expressed as orthogonal coordinates, such as (x, y, z), or cylinder coordinates, such as (r, θ, φ) for each of the plurality of sound source signals.

According to example embodiments, the sound source location information obtaining unit 120 may obtain the sound source location information using at least one of a location of the plurality of spot microphones, the delay time of the plurality of sound source signals in the microphone array, and the SPL of the plurality of sound source signals in the microphone array.

Also, according to other example embodiments, the sound source location information obtaining unit 120 may obtain the sound source location information by receiving a location of the plurality of sound sources inputted by a user of the object based audio contents generating apparatus 100.

The recording space information obtaining unit 130 obtains recording space information with respect to a recording space of the plurality of sound source signals.

Here, the recording space information is information with respect to a space where the plurality of sound sources to be recorded are to be played.

As described above, according to example embodiments, the object based audio contents generating apparatus 100 may further include the room impulse signal emitting unit 160 and the room impulse signal receiving unit 150.

The room impulse signal emitting unit 160 emits an impulse sound source signal.

The impulse sound source signal is a signal used for calculating an impulse response which will be described below.

As an example, the room impulse signal emitting unit 160 may emit a maximum-length sequence (MLS) signal.

The room impulse signal receiving unit 150 receives the impulse sound source signal emitted from the room impulse signal emitting unit 160, and calculates the impulse response based on the received impulse sound source signal.

The impulse sound source signal received in the room impulse signal receiving unit 150 includes a sound signal that directly arrives at the room impulse signal receiving unit 150 from the sound source signal emitting unit 150 and all sound signals arrive at the room impulse signal receiving unit 150 by being reflected from a surface of a wall of the recording space, an object existing in the recording space, and the like after being emitted from the room impulse signal emitting unit 160.

In this instance, the recording space information obtaining unit 130 may obtain the recording space information based on the calculated impulse response, and according to example embodiments, the impulse response may include a plurality of impulse signals, and the recording space information may include at least one of a incoming time difference between the plurality of impulse signals, an SPL difference between the plurality of impulse signals, a incoming azimuth difference between the plurality of signals. That is, the recording space information obtaining unit 130 may obtain the impulse response with respect to the recording space in a form of data, as well as in a form of an audio format, such as a wave file. The recording space information may be expressed as an ordered pair of a time, a sound pressure, and an angle, when the recording space information includes all of the incoming time difference, the SLP difference, and the incoming azimuth difference described above.

The encoding unit 140 generates object based audio contents by encoding at least one of the plurality of object audio signals, the recording space information, and sound source location information.

In this instance, each of the plurality of object audio signals may be encoded through various schemes. As an example, when an object audio signal is a music signal, the encoding unit 140 may encode the object audio signal by applying an audio encoding scheme optimal to the music signal, such as a transform based audio encoding scheme, and when the object audio signal is a speech signal, the encoding unit 140 may encode the object audio signal by applying an audio encoding scheme optimal to the speech signal, such as a code excited linear prediction (CELP) structural audio encoding scheme.

In this instance, the encoding unit 140 may generate the object based audio contents by multiplexing an encoded object audio signal, encoded sound source location information, and encoded recording space information.

The object based audio contents generated in the encoding unit 140 may be transmitted via a network or may be stored in a separate recording media.

As described above, the object based audio contents generating apparatus 100 according to example embodiments encodes each of the plurality of object audio signals, as opposed to mixing the plurality of the object audio signals to encode in a form of a multi-channel audio signal, generates the object based audio contents by adding additional information, such as the sound source location information, recording space information, and the like, to the encoded object audio signal, thereby enabling the user of an object based audio contents playing apparatus to generate object based audio contents appropriate for its object based audio contents playing apparatus. The object based audio content playing apparatus will be described with reference to FIG. 3.

Figure 2:
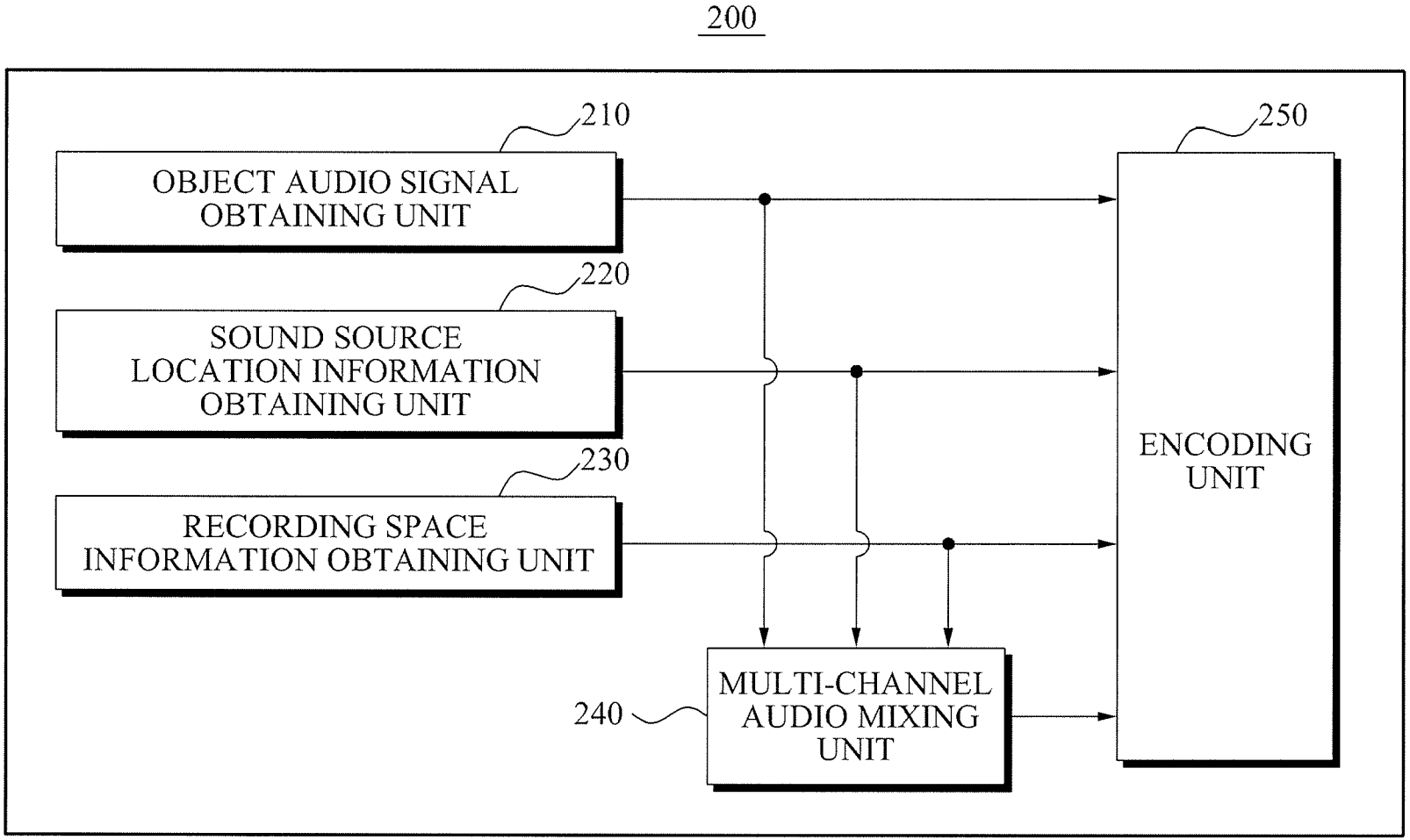
FIG. 2 is a block diagram illustrating a detailed configuration of an object based audio contents generating apparatus according to other example embodiments.

FIG. 2 is a block diagram illustrating a detailed configuration of an object based audio contents generating apparatus according to other example embodiments.

According to other example embodiments, the object based audio contents generating apparatus 200 includes an object audio signal obtaining unit 210, a sound source location information obtaining unit 220, a recording space information obtaining unit 230, a multi-channel audio mixing unit 240, and an encoding unit 250.

The object audio signal obtaining unit 210, the sound source location information obtaining unit 220, the recording space information obtaining unit 230, and the encoding unit 250 of FIG. 2 respectively correspond to the object audio signal obtaining unit 110, the sound source location information obtaining unit 120, the recording space information obtaining unit 130, and the encoding unit 140 of FIG. 1. Accordingly, description of the object based audio contents generating apparatus 100 of FIG. 1 is applicable to the object based audio contents generating apparatus 200 of FIG. 2, although the description is omitted hereinafter.

The object audio signal obtaining unit 210 obtains a plurality of object audio signals by recording a plurality of sound source signals.

The sound source location obtaining unit 220 obtains sound source location information of the plurality of sound source signals.

The recording space information obtaining unit 230 obtains recording space information with respect to a recording space of the plurality of sound source signals.

The multi-channel audio mixing unit 240 generates a multi-channel audio signal by mixing at least one of the plurality of object audio signals, the recording space information, and the sound source information.

That is, the multi-channel audio mixing unit 240 may generate the multi-channel audio signal, such as a 2 channel audio signal, a 5.1 channel audio signal, a 7.1 channel audio signal, and the like, by mixing at least one object audio signal, the sound source location information, and recording space information, for backwards compatibility with an audio contents playing apparatus according to a multi-channel surround playing scheme.

The encoding unit 250 generates the object based audio contents by encoding at least one of the plurality of object audio signals, the recording space information, the sound source location information, and the multi-channel audio signal.

Figure 3:
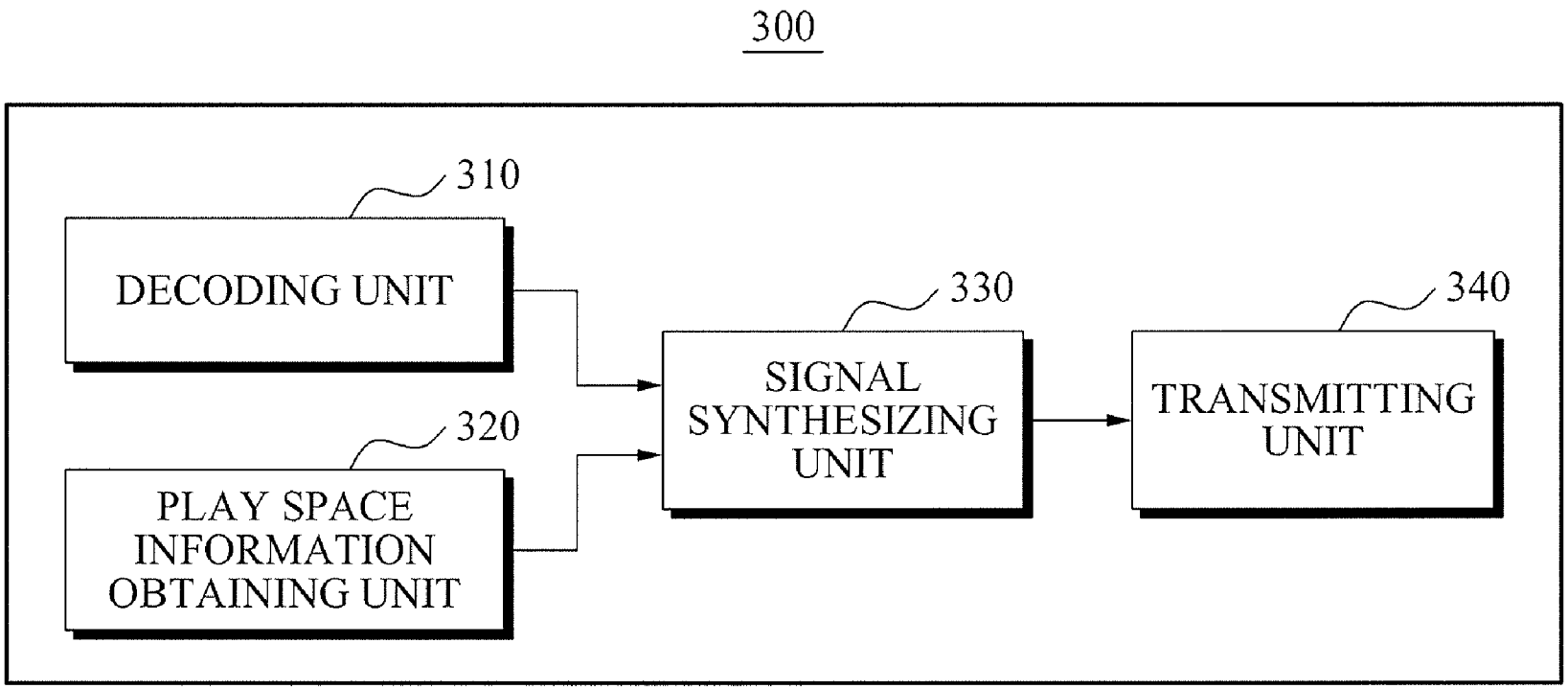
FIG. 3 is a block diagram illustrating a detailed configuration of an object based audio contents playing apparatus according to example embodiments.

FIG. 3 is a block diagram illustrating a detailed configuration of an object based audio contents playing apparatus according to example embodiments.

The object based audio contents playing apparatus 300 according to example embodiments includes an encoding unit 310, a reproducing space information obtaining unit 320, a signal synthesizing unit 330, and a transmission unit 340. Hereinafter, a function of each element will be described.

The encoding unit 310 decodes a plurality of object audio signals with respect to a plurality of sound source signals and sound source location information of the plurality of sound source signals, from the object based audio contents.

The object based audio contents may be transmitted from an object based audio contents generating apparatus or may be read from a separate recording medium.

The decoding unit 310 may generate a plurality of encoded object audio signals and encoded sound source location information by demultiplexing the object based audio contents, and may restore the plurality of object audio signals, recording space information, and sound source location information from the generated encoded plurality of object audio signals and the generated encoded sound source information.

The reproducing space information obtaining unit 320 obtains reproducing space information with respect to a reproducing space of the plurality of object audio signals.

The reproducing space information is information with respect to a reproducing space of a user where the object based audio contents is to be played, and a plurality of speakers that plays the object based audio contents may be arranged in the reproducing space.

Accordingly, according to example embodiments, the reproducing space information may include at least one of a number of the plurality of speakers arranged in the reproducing space, an interval between the plurality of speakers, an arrangement angle of the plurality of speakers, a type of speakers, location information of speakers, and size information of the reproducing space.

Also, according to example embodiments, the reproducing space information obtaining unit 320 may receive the reproducing space information directly inputted from the user, and may calculate the reproducing space information using a separate microphone arranged in the reproducing space.

The signal synthesizing unit 330 synthesizes a plurality of speaker signals from a decoded object audio signal from among the plurality of decoded object audio signals based on the sound source location information and the reproducing space information.

That is, the signal synthesizing unit 330 synthesizes the plurality of speaker signals to effectively play the object based audio contents, based on the object audio signal, the sound source location information, and the reproducing space information. In this instance, the plurality of speaker signals are generated by synthesizing the plurality of object audio signals according to recording space information.

According to example embodiments, when the object audio signal capable of being played in a WFS scheme based on the size of the reproducing space, the number of speakers installed in the reproducing space, the type of speakers, and the location of speakers, the signal synthesizing unit 330 performs rendering of an object audio signal according to the WFS scheme, and when the object audio signal is not capable of being played in the WFS scheme based on the size of the reproducing space, the number of speakers installed in the reproducing space, the type of speakers, and the location of speakers, the signal synthesizing unit 330 synthesizes a speaker signal by rendering the object audio signal according to a multi-channel surround play scheme. When the object audio signal is rendered in an environment where a speaker array is installed, according to the multi-channel surround play scheme, the signal synthesizing unit 330 may select a desired speaker to play the object audio signal.

As an example, in a case that a loudspeaker array is arranged in front of the reproducing space based on an audience, and a 2 channel surround speaker is installed behind the reproducing space, when the audio object, that is, the sound source, exists in an angle between both ends of the loudspeaker array based on the audience, the signal synthesizing unit 330 performs rendering of an object audio signal with respect to the corresponding audio object using the sound length synthesis scheme, and when the audio object exists in other angles, the signal synthesizing unit 330 performs rendering of an audio object signal with respect to the audio object existing in other angles by applying a power panning law using a satellite surround loudspeaker.

The transmission unit 340 respectively transmits the plurality of speaker signals to corresponding speakers. A transmitted speaker signal is played via a corresponding speaker.

According to example embodiments, the encoding unit 310 further decodes a plurality of sound source recording space information from the object based audio contents, and the signal synthesizing unit 330 generates a direct sound with respect to the plurality of sound source signals from the object audio signal using the object audio signal, sound source information, and reproducing space information, and synthesizes the plurality of speaker signals by adding a reflected sound to the generated direct sound based on the recording space information.

As an example, in a case that the loudspeaker array is arranged in front of the reproducing space and the plurality of object audio signals is intended to be played via the loudspeaker array using the WFS scheme, the signal synthesizing unit 330 may generate the direct sound with respect to the plurality of sound source signals by rendering the plurality of object audio signals based on Equation 1 or Equation 2 as given below.

$$Q(\vec{r}_n, \omega) = S(\omega)\sqrt{\frac{|z-z_1|}{|z-z_0|}}\,\frac{\cos(\theta_n)}{G_n(\theta_n, \omega)}\sqrt{\frac{jk}{2\pi}}\,\frac{e^{-j|\vec{r}_n-\vec{r}_m|}}{\sqrt{|\vec{r}_n-\vec{r}_m|}} \quad \text{[Equation 1]}$$

$$Q'(\vec{r}_n, \omega) = N_n \cdot S(\omega)\sqrt{\frac{jk}{2\pi}}\,\frac{\cos(\theta_n)}{G_n(\theta_n-\alpha_n, \omega)}\sqrt{\frac{|z-z_1|}{|z-z_0|}}\,\frac{e^{-jk|\vec{r}_n-\vec{r}_m|}}{\sqrt{|\vec{r}_n-\vec{r}_m|}} \quad \text{[Equation 2]}$$

Here, $Q(\vec{r}_n, \omega)$ is a driving function of an audio signal emitted from an $n^{th}$ loudspeaker of the loudspeaker array, $Q'(\vec{r}_n, \omega)$ is a driving function of an audio signal emitted from an $n^{th}$ loudspeaker of a tilted loudspeaker array, $S(\omega)$ is a virtual sound source signal, $G_n(\theta_n, \omega)$ is a factor to weight a sound pressure by directional characteristics of the loudspeaker, Z is coordinate information of the loudspeaker, $Z_0$ is coordinate information of the sound source, $Z_1$ is coordinate information of a virtual sound source, k is a wave number, ω is a angle velocity, $\theta_n$ is an angle between the $n^{th}$ loudspeaker and the audience, $\vec{r}_n$ is a distance between the sound source and the audience, $\vec{r}_m$ is a distance between the loudspeaker and the audience, $N_n$ is a normalization parameter, and $\alpha_n$ is an angle between the tilted loudspeaker and the audience.

Also, in Equation 1 and Equation 2, $$\sqrt{\frac{|z-z_1|}{|z-z_0|}}$$

is a weight with respect to a size of the virtual sound source signal, $$\sqrt{\frac{jk}{2\pi}}$$

is a high frequency amplifying equalizing coefficient, $e^{-jk|\vec{r}_n-\vec{r}_m|}$ is a delivery time occurring due to a distance between the virtual sound source and the $n^{th}$ loudspeaker, $\cos(\theta_n)$ is a distance ratio of a virtual sound source with respect to a vertical distance and the $n^{th}$ loudspeaker, and $$\frac{1}{\sqrt{|\vec{r}_n-\vec{r}_m|}}$$

is a single cylindrical wave.

Subsequently, the signal synthesizing unit 330 may operate, according to a grouped reflections algorithm, the direct sound generated according to Equation 1 and Equation 2 and the recording space information expressed as an ordered combination of time, sound pressure, and angle, and may add initial reflected sound information of the recording space to the directed sound. In this instance, the signal synthesizing unit 330 assigns each reflected sound to the loudspeaker using angle information included in the reflected sound information, and when the loudspeaker does not exist in a corresponding angle, the signal synthesizing unit 330 synthesizes a speaker signal to enable the reflected sound to be played in a loudspeaker adjacent to the corresponding angle.

Also, according to example embodiments, the signal synthesizing unit 330 may add a reverberation effect to the speaker signal using an infinite impulse response filter (IIR filter).

As described above with reference to FIG. 2, according to example embodiments, the object audio signal may further include the multi-channel audio signal. In a case that the audio signal to be played is a channel based signal and the reproducing space is set to be appropriate for the WFS scheme but the audience intends to play the audio signal according to a multi-channel surround scheme, the signal synthesizing unit 330 may select a loudspeaker and synthesizes a speaker signal to enable the object based audio contents to be played according to the multi-channel surround play scheme. As an example, in a case that the multi-channel audio signal is a 5.1 channel audio signal, the loudspeaker array is in front of the reproducing space, and 2 channel surround speaker is behind the reproducing space, the signal synthesizing unit 330 selects a loudspeaker arranged at 0°, ±30°, and ±110° based on the front of the audience, and synthesizes the speaker signal to enable the object based audio contents to be played via the selected loudspeaker.

Also, when the audio signal to be played is the multi-channel audio signal, and the reproducing space is set to be appropriate for the multi-channel surround scheme, the signal synthesizing unit 330 enables the object based audio contents to be played according to the multi-channel surround scheme.

As described above, the object based audio contents play apparatus 300 according to example embodiments may play the object based audio contents using at least one of the WFS scheme and the multi-channel surround scheme regardless of a reproducing environment of the audience.

Figure 4:
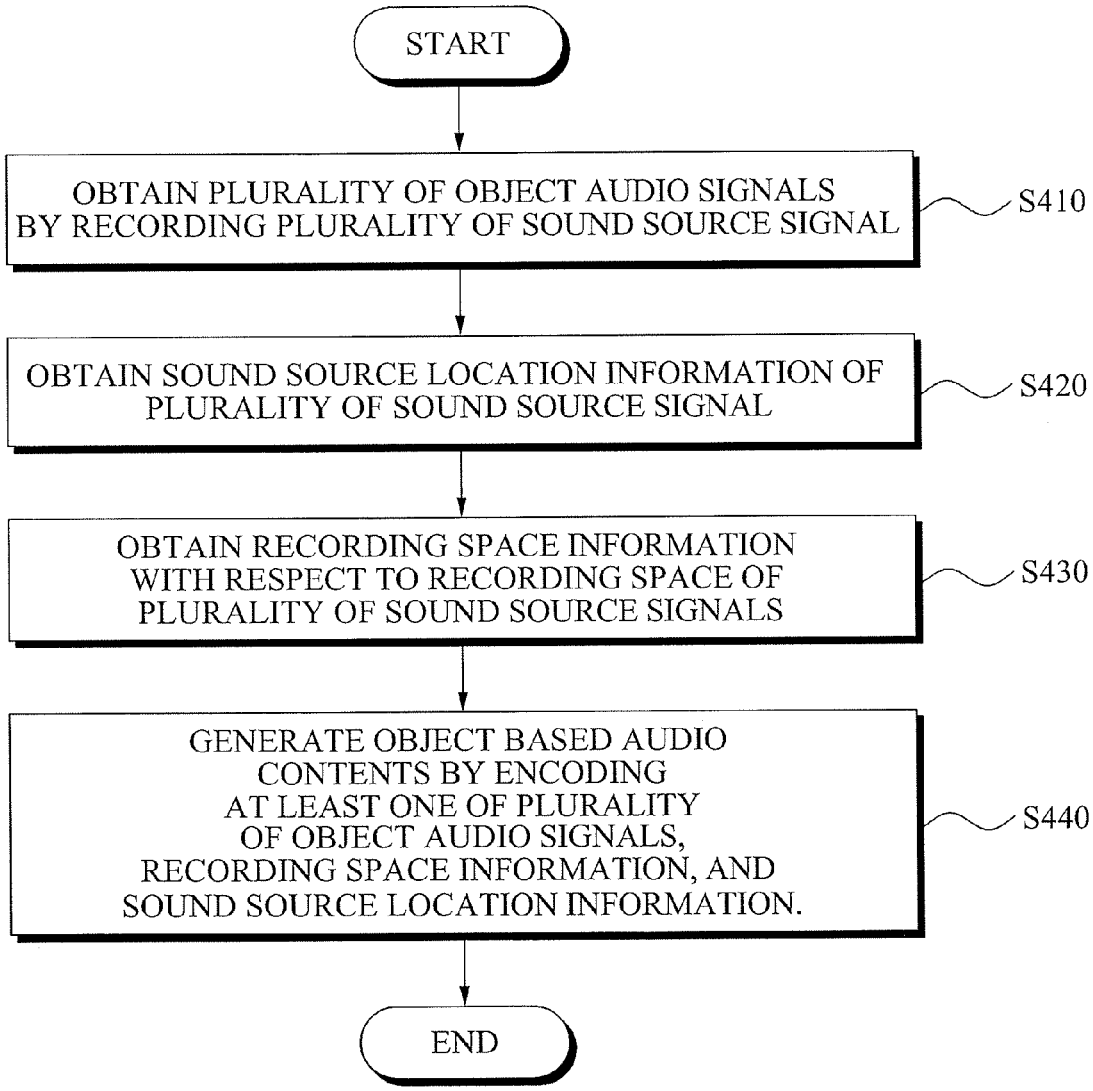
FIG. 4 is a flowchart illustrating an object based audio contents generating method according to example embodiments.

FIG. 4 is a flowchart illustrating an object based audio contents generating method according to example embodiments. Hereinafter, a procedure performed in each operation will be described with reference to FIG. 4.

In operation S410, a plurality of object audio signals are obtained by recording a plurality of sound source signals.

According to example embodiments, the plurality of object audio signals may be obtained using at least one of a plurality of spot microphones and a microphone array in operation 5410.

In operation S420, sound source location information of the plurality of sound source signals is obtained.

According to example embodiments, the sound source location information may be obtained using at least one of a location of the plurality of spot microphones, a delay time of the plurality of sound source signals in the microphone array, an SPL of the plurality of sound source signals in the microphone array.

Also, according to other example embodiments, in operation S420, the sound source location information may be obtained by receiving a location of the plurality of sound sources inputted by a user.

In operation S430, recording space information with respect to the plurality of sound source signals is obtained.

According to example embodiments, the object based audio contents generating method may further include an operation (not illustrated) of emitting an impulse sound source signal and receiving the emitted impulse sound source signal, and an operation (not illustrated) of calculating an impulse response based on the received impulse sound source signal. In this instance, the recording space information may be obtained based on the calculated impulse response in operation S430. Also, in this instance, according to example embodiments, the impulse response includes a plurality of impulse signals, and the recording space information includes at least one of a incoming time difference between the plurality of impulse signals, an SPL difference between the plurality of impulse signals, and a incoming azimuth difference between the plurality of impulse signals.

In operation 5440, object based audio contents are generated by encoding at least one of the plurality of object audio signals, the recording space information, and the sound source location information.

Also, according to example embodiments, the object based audio contents generating method may further include an operation of generating a multi-channel audio signal by mixing at least one of the plurality of object audio signals, the recording space information, and the sound source location information. In this instance, the object based audio contents may be generated by encoding at least one of the plurality of object audio signals, the recording space information, the sound source location information, and the multi-channel audio signal in operation S440.

Figure 5:
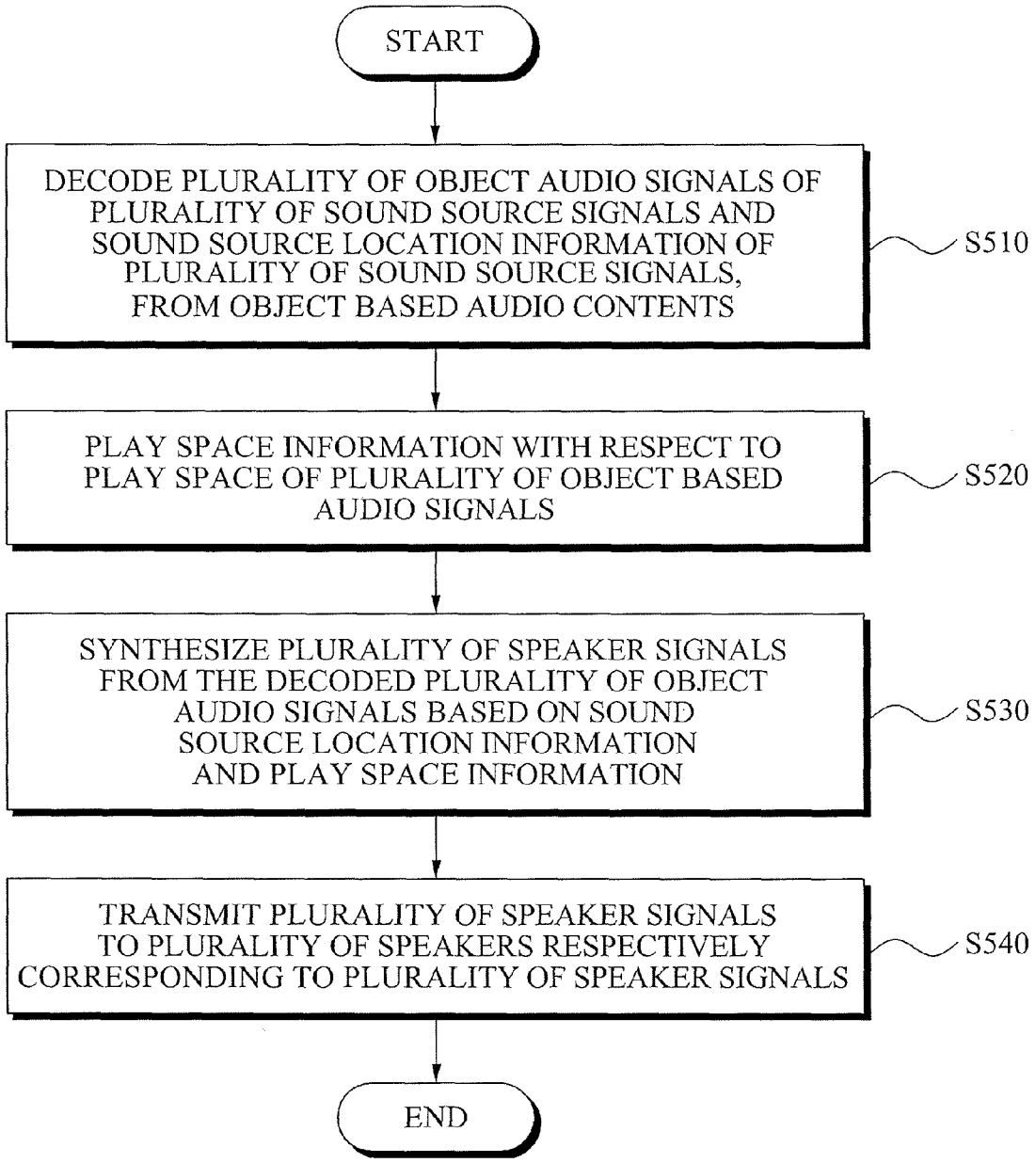
FIG. 5 is a flowchart illustrating an object based audio contents playing method according to example embodiments.

FIG. 5 is a flowchart illustrating an object based audio contents playing method according to example embodiments. Hereinafter, a procedure performed in each operation will be described with reference to FIG. 5.

In operation S510, a plurality of object audio signals with respect to a plurality of sound sources and sound source location information with respect to a plurality of sound source signals are decoded from the object based audio contents.

In operation S520, reproducing space information with respect to a reproducing space of the plurality of object audio signals is obtained.

According to example embodiments, the reproducing space information may include at least one of a number of a plurality of speakers arranged in the reproducing space, an interval between the plurality of speakers, an arrangement angle of the plurality of speakers, a type of speakers, location information of the speakers, and size information of the reproducing space.

Also, according to example embodiments, the reproducing space information may be directly received from the user or may be calculated using a separate microphone arranged in the reproducing space in operation S520.

In operation S530, a plurality of speaker signals is synthesized from decoded object audio signal based on the sound source location information and reproducing space information.

According to example embodiments, a reverberation effect may be added to the plurality of speaker signals using an IIR filter in operation 5530.

In operation S540, the plurality of speaker signals are respectively transmitted to corresponding speakers. A transmitted speaker signal may be played via a corresponding speaker.

A few example embodiments of the object based audio contents generating/playing method have been shown and described, and the object based audio contents generating/playing apparatus described in FIG. 1 through FIG. 3 is applicable to the present example embodiment. Accordingly, detailed descriptions thereof will be omitted.

The object based audio contents generating/playing method according to the above-described example embodiments may be recorded in computer-readable media including program instructions to implement various operations embodied by a computer. The media may also include, alone or in combination with the program instructions, data files, data structures, and the like. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described example embodiments, or vice versa.

Although a few example embodiments have been shown and described, it would be appreciated by those skilled in the art that changes may be made in these example embodiments without departing from the principles and spirit of the invention, the scope of which is defined in the claims and their equivalents.

What is claimed is:

1. An apparatus of generating an object based audio contents, the apparatus comprising:

an object audio signal obtaining unit to obtain a plurality of object audio signals by recording a plurality of sound source signals;

a recording space information obtaining unit to obtain recording space information with respect to a recording space of the plurality of sound source signals;

a sound source location information obtaining unit to obtain sound location information of the plurality of sound source signals;

an encoding unit to generate object based audio contents by encoding at least one of the recording space information, and the sound source location information, and the plurality of object audio signals;

an impulse sound source signal emitting unit to emit an impulse sound source signal; and an impulse sound signal receiving unit to receive the impulse sound source signal and to calculate an impulse response based on the received impulse sound source signal, wherein the received impulse sound source signal includes a sound signal that directly arrives at the impulse sound signal receiving unit from the impulse sound source signal emitting unit and all sound signals that arrive at the impulse sound signal receiving unit by being reflected from surfaces of walls of the recording space and objects existing in the recording space after being emitted from the impulse sound source signal emitting unit;

the impulse response includes a plurality of impulse signals; and the recording space information includes at least one of a incoming time difference between the plurality of impulse signals, a sound pressure level difference between the plurality of impulse signals, and a incoming azimuth difference between the plurality of impulse signals.

2. The apparatus of claim 1, wherein the object audio signal obtaining unit obtains the plurality of object audio signals using at least one of a plurality of spot microphones and a microphone array.

3. The apparatus of claim 2, wherein the sound source location information obtaining unit obtains the sound source location information using at least one of locations of the plurality of spot microphones, a delay time of the plurality of sound source signals in the microphone array, a sound pressure level of the plurality of sound source signals in the microphone array.

4. The apparatus of claim 1, further comprising:

a multi-channel audio mixing unit to generate a multi-channel audio signal by mixing at least one of the plurality of object audio signals, the recording space information, and the sound source location information, wherein the encoding unit further encodes the multi-channel audio signal.

5. An apparatus of reproducing object based audio contents, the apparatus comprising:

a decoding unit to decode a plurality of object audio signals of a plurality of sound source signals and sound source location information of the plurality of sound source signals, from the object based audio contents;

a reproducing space information obtaining unit to obtain reproducing space information with respect to a reproducing space of the plurality of object based audio contents;

a signal synthesizing unit to synthesize a plurality of speaker signals from the decoded plurality of object audio signals based on the sound source location information and the reproducing space information, wherein when the object audio signal is capable of being played in a wave field synthesis (WFS) scheme based on the reproducing space information, the signal synthesizing unit performs rendering of the object audio signal according to the WFS scheme, when the object audio signal is not capable of being played in the WFS scheme based on the reproducing space information, the signal synthesizing unit synthesizes a speaker signal by rendering the object audio signal according to a multi-channel surround play scheme, and when the object audio signal is rendered in an environment where a speaker array is installed, according to the multi-channel surround play scheme, the signal synthesizing unit may select a desired speaker to play the object audio signal; and a transmitting unit to transmit the plurality of speaker signals to a plurality of speakers respectively corresponding to the plurality of speaker signals.

6. The apparatus of claim 5, wherein the reproducing space information includes at least one of the plurality of speakers, an interval between the plurality of speakers, an arrangement angle of the plurality of speakers, a type of the plurality of speakers, location information of the speaker, and size information of the reproducing space.

7. The apparatus of claim 5, wherein the decoding unit further decodes recording space information of the plurality of sound source signals from the object based audio contents, and the signal synthesizing unit directly generates a direct sound with respect to the plurality of sound source signals from the object based audio signal using the sound source location information and the reproducing space information, and synthesizes the plurality of speaker signals by adding a reflection sound to the direct sound based on the direct sound and the recording space information.

8. The apparatus of claim 5, wherein the signal synthesizing unit adds a reverberation effect to the speaker signal using an infinite impulse response filter.

9. An apparatus of generating an object based audio contents, the apparatus comprising:

a plurality of spot microphones and a microphone array;

an object audio signal obtaining unit to obtain a plurality of object audio signals by recording a plurality of sound source signals using at least one of the plurality of spot microphones and the microphone array;

a recording space information obtaining unit to obtain recording space information with respect to a recording space of the plurality of sound source signals;

a sound source location information obtaining unit to obtain sound location information of the plurality of sound source signals using at least one of locations of the plurality of spot microphones, a delay time of the plurality of sound source signals in the microphone array, a sound pressure level of the plurality of sound source signals in the microphone array, wherein the delay time of the plurality of sound source signals include at least one of a delay time between a plurality of sound sources that arrive at a single microphone from among the plurality of microphones constituting the microphone array, and a delay time of a sound source signal that arrives at each of the plurality of microphones, when a single sound source signal arrives at each of the plurality of microphones;

an encoding unit to generate object based audio contents by encoding at least one of the recording space information, and the sound source location information, and the plurality of object audio signals;

an impulse sound source signal emitting unit to emit an impulse sound source signal; and an impulse sound signal receiving unit to receive the impulse sound source signal and to calculate an impulse response based on the received impulse sound source signal, wherein the impulse sound source signal includes a sound signal that directly arrives at the impulse sound signal receiving unit from the impulse sound source signal emitting unit and all sound signals arrive at the impulse sound signal receiving unit by being reflected from surfaces of walls of the recording space and objects existing in the recording space after being emitted from the impulse sound source signal emitting unit;

the impulse response includes a plurality of impulse signals; and the recording space information includes at least one of a incoming time difference between the plurality of impulse signals, a sound pressure level difference between the plurality of impulse signals, and a incoming azimuth difference between the plurality of impulse signals.

* * * * *